United States Patent [19]

Johnson

[11] Patent Number: 4,625,778

[45] Date of Patent: Dec. 2, 1986

[54] AUTOMATIC VENTING VALVE FOR GAS STORAGE TANK

[75] Inventor: Howard Johnson, West Valley City, Utah

[73] Assignee: HMH, Inc., West Valley City, Utah

[21] Appl. No.: 727,731

[22] Filed: Apr. 26, 1985

[51] Int. Cl.[4] ..... B65B 3/04

[52] U.S. Cl. ..... 141/301; 141/303

[58] Field of Search ..... 141/285–310

[56] References Cited

U.S. PATENT DOCUMENTS 2,771,917 11/1956 Cannell ..... 141/303

4,144,915 3/1979 Henderson et al. ..... 141/303

*Primary Examiner*—Houston S. Bell, Jr.

*Attorney, Agent, or Firm*—Thorpe, North and Western

[57] ABSTRACT

A control valve for blocking atmospheric venting of gas fumes contained within a gasoline storage tank during tanker refill operations and which is adapted for attachment to the end of a venting tube coupled to the open space within the tank. The control valve comprises a tubular valve casing and a valve seat and seating member which are coupled within the valve casing, the seating member being reversibly displaceable along a flow channel therein between (i) a rest position toward the bottom of the casing which permits gradual air flow for pressure equalization of the tank and (ii) a sealed or seated position at the valve seat, wherein all flow of air or gas fumes is blocked. The seated position is developed in response to rapid exhaust of gas fumes through the flow channel, driving the seating member into the seated position. Loss of gas fumes into the atmosphere is therefore precluded during refill of the gas tank, requiring the tanker operator to withdraw pressurized gas fumes into the tanker shell.

11 Claims, 5 Drawing Figures

AUTOMATIC VENTING VALVE FOR GAS STORAGE TANK

BACKGROUND OF THE INVENTION

1. Field of the Invention

This invention pertains to a valve for use with a venting tube coupled to a gasoline storage tank for providing air intake for pressure equalization as gasoline is removed from the tank, while at the same time providing valve structure which can seal itself during tank refill operations against venting of gas fumes to the atmosphere.

2. Prior Art

Antipollution requirements have attempted to restrict the venting of gasoline fumes into the atmosphere for many years. For gas stations, these requirements necessitate the cooperation of tanker operators who refill gasoline storage tanks. Despite the importance of conversation and clean air regulations, refill operations continue to result in substantial air pollution through release of gas fumes accumulated in gas storage tanks.

A basic tank storage system is illustrated in FIG. 1. Typically, the tank 10 is below ground level 11. The gas pump 12 is coupled to the stored gas 13 within the tank via conduit 14. When the tank is full of liquid gas, there is little remaining volume left for gas vapor. As gas is removed through the pump 12, the unfilled volume 15 increases. To prevent collapse of the tank due to vacuum forces arising with fluid discharge, a venting tube 16 is coupled to the open space 15 at the top of the tank. This venting tube enables pressure equalization between the contained volume within the tank and outer atmosphere.

Such venting tubes are generally equipped with an on/off valve 17 which is supposed to be operated by the tanker operator during refill procedures. Specifically, prior to filling the tank 10 through an inlet tube 18, the operator should close the venting valve 17. Failure to do this results in rapid discharge of the contained gas fumes from the tank as the incoming liquid gas drives the fumes contained in the open space 15 out the venting tube 16. When the venting valve has been properly closed, the fumes are retained in the tank and build in pressure as the tank is filled. Upon completion of fluid discharge, the operator should properly vent the pressurized fumes into the tanker for controlled disposition. Finally, the venting valve should be reopened. If the operator fails to open the venting valve, the tank may be collapsed upon withdrawal of gas through the pump 12. In view of the risk of forgetting to reopen the valve, as well as a disconcern for the effects of venting the contained fumes to the atmosphere, many operators simply ignore these proper procedures.

In an effort to meet the requirements of antipollution regulations, several devices have been developed to automatically withdraw gas fumes concurrently with the refill operation. U.S. Pat. No. 4,094,346 of Milo discloses a tank manifold which includes a liquid fill section to dispense gas into the tank, and a vapor return section to permit extraction of fumes. This vapor return section comprises a float valve which is designed to close in response to backfill of liquid gas. When in the open position, the vapor return channels the fumes back to the tanker. It is designed to remain open in response to venting fumes from the gasoline storage tank.

Other prior art which is somewhat related to vapor recovery includes U.S. Pat. Nos. 3,983,913 by Bower; 2,802,492 by Gosselin; 3,732,902 by Muller; and 3,907,010 by Burtis, et al. Each of these patents disclose method or structure for vapor recovery. In each case, however, the proposed solution to the vapor control problem involves modification of the tanker with expensive equipment to monitor fluid levels, vapor pressure and flow, or other parameters which assist in regulation of the refilling procedure. The expense and maintenance requirement of this specialized equipment presents a serious impediment to voluntary compliance with antipollution practice.

OBJECTS AND SUMMARY OF THE INVENTION

It is therefore an object of the subject invention to provide a vapor control system which is suited for attachment to existing storage tanks without significant expense or modification.

It is a further object of this invention to provide a valve which is attached to the venting tube of a tank which automatically prevents rapid discharge of fumes during refill.

It is an object of this invention to provide a valve which retains gas fumes in the storage tank and forces the tank operator to recover these fumes in the tanker before disconnecting the tanker hose from the inlet tube of the storage tank.

It is a still further object of this invention to provide a vapor control device which prevents rapid escape of trapped fumes while permitting proper pressure equalization during gas withdrawal, without any action required on the part of the tanker operator.

These and other objects are realized in a control valve for blocking atmospheric venting of gas fumes contained within a gasoline storage tank during tanker refill operations wherein the gasoline tank includes a venting tube coupled to open space within the top of the tank to provide air intake for pressure equalization as gasoline is gradually removed from the tank. The valve comprises a rigid, tubular valve casing having a bottom and top opening and a flow channel therebetween. The bottom opening has a shoulder flange which permits attachment of the casing to a top end of the venting tube by insertion thereof into the bottom opening. A valve seat and seating member are coupled to the casing within the flow channel. The seating member is reversibly displaceable along the flow channel between a (i) rest position toward the bottom end of the casing and (ii) a sealed position wherein the seating member is in a seated position at the valve seat toward the top end of the casing. An annular disk or other type of retaining member is positioned across a portion of the flow channel and provides a rest position for the seating member. Weep holes placed within the annular disk permit air flow between an exterior environment and an unblocked segment of the flow channel when the seating member is in the rest position. This structure permits gradual venting between the atmosphere and the increasing volume of the storage tank as gas is removed through the gas pump. This same structure operates to seal at the valve seat upon rapid exhaust of gas fumes through the venting tube. Such exhaust occurs as a tanker operator fills an emptied tank with liquid gas. As the escaping gas fumes enter the flow channel, they drive the seating member into the seated position and block further escape of fumes. These fumes are therefore contained within the gas tank and must be discharged by the tanker operator into his vehicle tank.

Other objects and features of the present invention will be apparent to those skilled in the art based upon the following detailed description of the preferred embodiments, taken in combination with the following drawings, wherein.

Figure 3:
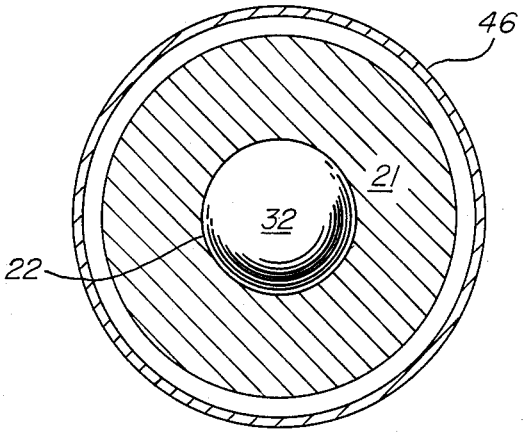

FIG. 3 presents a cross-sectional view of the full valve section, taken along the lines 3—3.

Figure 4:
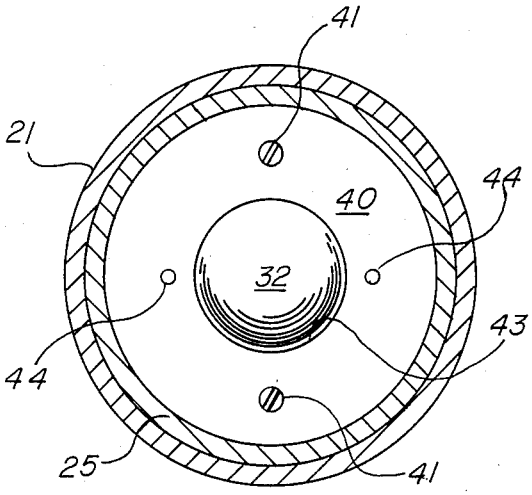

FIG. 4 presents a cross-sectional view of the full valve section, taken along the lines 4—4.

Figure 5:
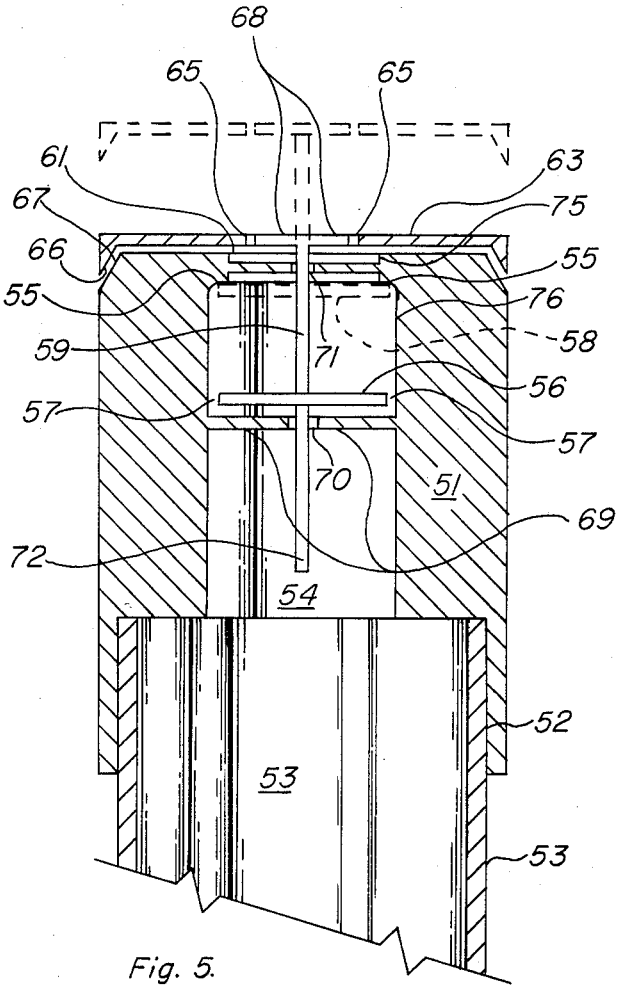

FIG. 5 depicts a second preferred embodiment of the subject invention.

DETAILED DESCRIPTION OF THE DRAWINGS

Figure 1:
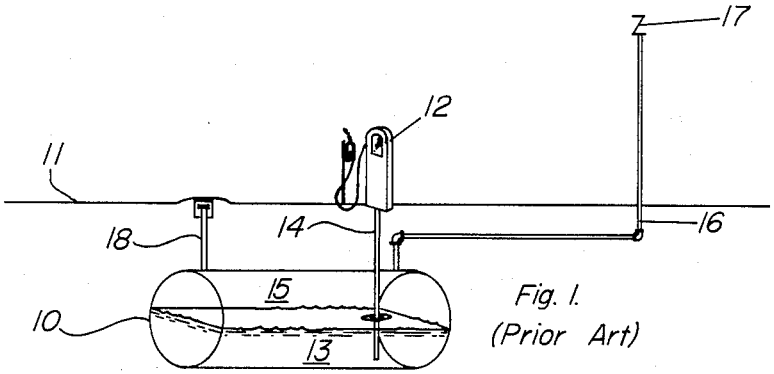
Fig. 1. (Prior Art)
FIG. 1 shows a prior art graphic representation of a typical gasoline storage tank with venting tube.
Figure 2:
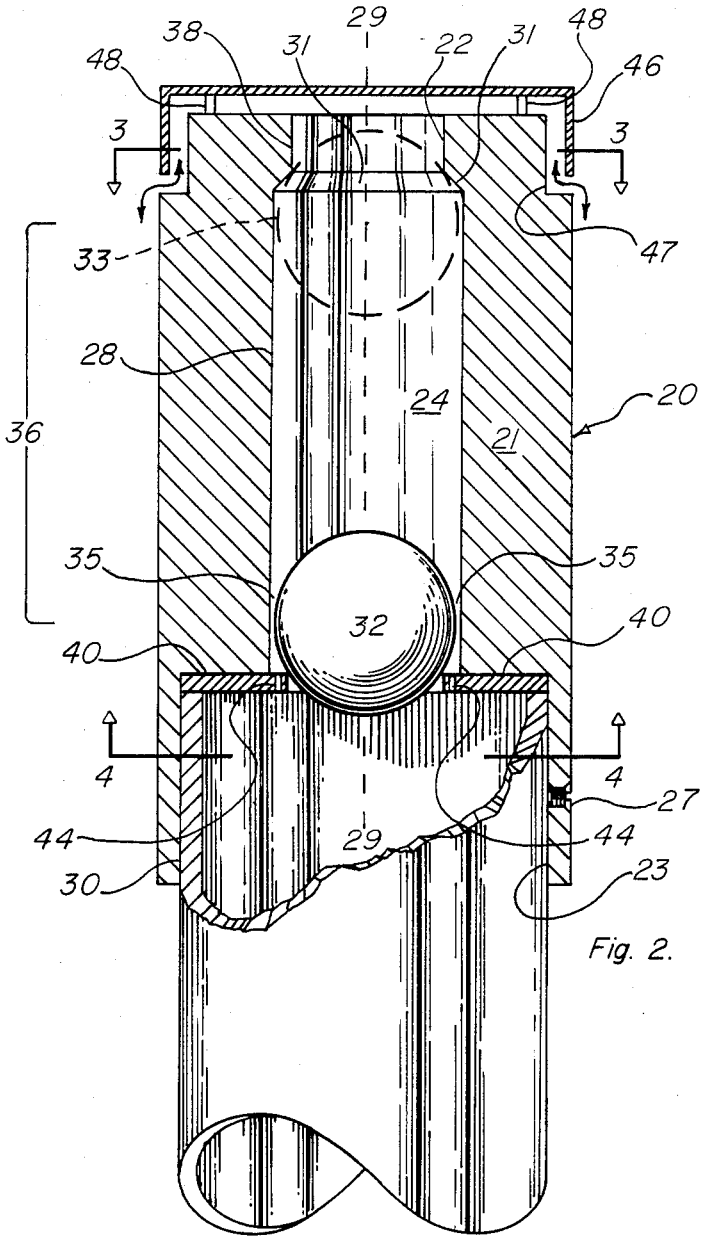
FIG. 2 depicts a cross-sectional view of the most preferred embodiment of a control valve which is placed at the top of the venting tube.

The subject control valve is shown generally in FIG. 2 as Item 20. The valve structure includes a rigid, tubular valve casing 21 which has a top opening 22 and a bottom opening 23. These respective top and bottom openings define the distal ends of a flow channel 24 for gases which move into and out of a venting tube 25 which is coupled to a gas storage tank such as the one illustrated as Item 13 in FIG. 1. Venting tube 16 of FIG. 1 corresponds to Item 25 of FIG. 2. The subject control valve 20 is a replacement for prior valves 17 represented in FIG. 1.

The bottom opening 23 is shown with a circular configuration to provide a means for attaching the bottom end of the casing 20 to the upper end of the venting tube 25. This configuration forms a continuation of the venting path from the venting tube and attached gas tank. A set screw 27 or other securing means can be added for fixing the channel in the proper position on the venting tube. In the illustrated configuration, the bottom opening 23 will correspond to the outer dimensions of the venting tube. A typical dimension for current venting tubes is 2 7/16" in outer diameter. Accordingly, the bottom opening 23 would be configured with a slightly larger inner-diameter than the referenced 2 7/16" outer diameter. It will be apparent to those skilled in the art that numerous configurations for attachment of the control valve to a venting tube are envisioned.

The embodiment disclosed in the drawings shows a casing which comprises a cylinder 21 which has a first tubular bore 28 along its central axis 29. This first bore operates as the primary flow channel and houses the valve components. A second tubular bore 30 has a larger radius adjusted in size to fit the outer diameter of the tubular vent 25. It will be noted that the relative radii of the first and second bores are not particularly significant. The second bore primarily operates as the means for attaching end of the casing to the upper end of the vending tube. The first bore serves the primary function of housing the valve components. Accordingly, its dimensions will depend upon the type of valve seat and seating member which are applied.

In the embodiment of FIG. 2, the valve seat 31 (also referred to as first valve seat) and seating member 32 are coupled or formed within the first tubular bore of the casing 28 and are contained within the primary flow channel 24. In this configuration, the seating member comprises a sphere 32 having a radius sufficiently small to allow the sphere to move freely within the flow channel 24. The primary positions for the seating member 32 are (i) a resting position toward the bottom end of the casing as shown in FIG. 2, and a (ii) sealed or seating position 33 at the valve seat 31. As will be noted hereafter, the sphere or seating member 32 is reversibly displaceable between the respective rest and sealed positions.

The proper displacement of the sphere 32 depends upon the dimensions and spacing of the sphere with respect to the first tubular bore 28. It will be noted that the diameter of the sphere 32 is substantially smaller than the diameter of the bore 28. This provides air space 35 around the periphery of the sphere such that the passage of gasses through the flow channel are not obstructed except when the sphere 32 is in the seated position 33. It should therefore be apparent that small quantities of air are allowed to pass in both directions of flow to allow pressure equalization within the gas tank. The size of the sphere with respect to the diameter of the first bore 28 should be such that the rate of flow for exhausting gas fumes caused by refill operations of the gas tank by a tank operator will cause the sphere 32 to displace to the seated position 33. In otherwords, the limited amount of air space 35 causes a pressure head to build which is sufficient to lift the sphere 32 into the seated position. Once seated, the continued introduction of gas liquid into the tank causes increased pressure to build because of the increasing pressure within the gas tank and venting tube. This pressure operates to prevent escape of exhaust fumes through the venting outlet. It is apparent that factors which influence the size of the sphere will include the size of the flow channel 28, the weight of the sphere 32 and the distance of required displacement 36 for relocation to the seated position 33. For a typical gasoline station application where the venting tube is approximately 2 7/16 inches in diameter, a stainless steel, hallow sphere of 1 3/16" in diameter has been found suitable for a bore radius of 1¼" and a displacement distance for seating of approximately 2 to 2½".

In the embodiment disclosed in FIG. 2, a third bore 38 is provided to form the valve seat 31. This third bore has a radius substantially smaller than the radius of the sphere 32. The valve seat is formed as a tapered section of gradually decreasing radius from the base of the third bore to the top portion of the first bore 28. This tapered section 31 provides the appropriate contact for sealing between the spherical surface and the wall section of the taper 31. In the disclosed embodiment, the diameter of this third bore 38 is approximately one (1) inch. The degree of taper is approximately forty-five (45) degrees from the vertical axis 29.

As previously indicated, rapid exhaust flow of gas fumes from the venting tube 25 force the sphere 32 into the seated position shown by the phantom lines of item 33. Otherwise, the sphere 32 rests under gravity force on an annular disk 40 which is positioned at the top of the second tubular bore 30. A pair of screws 41 secure the annular disk 40 to the valve casing 21. This annular disk or ring 40 functions as a retaining means (also referred to as second valve seat) across the flow channel 24 for providing a rest position for the seating member 32. The opening 43 of the annular ring is circular to provide a nesting position for the sphere 32. The weight of the steel sphere 32 is sufficient to seal that portion of the annular opening against rapid air movement. Gradual airflow for pressure equalization is developed through weep holes 44 which remain open and permit a slow rate of gas or airflow therethrough. Accordingly, the annular disk 40 with the sphere 32 in the resting position functions to impede fumes from escaping the tank at any significant flow rate. These weep holes 44 are positioned along the flow channel 24 such that communication between an exterior environment outside the vent tube or valve is maintained when the seating member 32 is in the rest position. As gas is withdrawn from the tank, the weep holes allow air flow into the tank at a sufficient rate to prevent collapse of the tank body in response to loss of pressure within the tank. Based on earlier dimensions recited for the structure of FIG. 2, two weep holes having a diameter of ⅛ inch each are sufficient in size to provide proper venting of the tank. It should be noted that as the sphere 32 is displaced to the seated position 33, the operation of the weep holes 44 becomes insignificant. During the displacement stage, the annular opening 43 provides uninhibited flow of gasses until the sphere 32 is seated at the valve seat 31. At that point, the flow channel is fully blocked.

A cap 46 may be provided to protect the venting tube from rainfall or debris entering the flow channel 24. A recessed portion or shoulder 47 of the casing 21 provides an air path for inflow and outflow of gasses. Support studs 48 suspend the cap above the opening 22 to maintain an open flow circuit.

FIG. 5 discloses an alternate embodiment of the subject control valve. It includes a rigid casing 51 similar in design and purpose with the casing 21 of FIG. 2. A lower opening 52 is provided for attaching the valve to a venting tube 53.

The embodiment of FIG. 5 does not include an annular disk, but has unobstructed flow from the vent tube 53 into a lower opening of the flow channel 54 and to the seating position 55. This flow channel 54 may be a circular design, or may assume any configuration which is compatible with development of sealing action between the seat member 56 and the valve seat 55. The particular configuration illustrated in FIG. 5 is a circular cross-section, with the seating member likewise comprising a circular shaped disk. A limited amount of air space 57 between the perimeter of the disk and the walls of the flow channel 54 developes the required displacement force to move the disk 56 from its rest position to its seated position 58 with a surge of gas fumes.

The seating member 56 is retained in the respective rest position and seated position by support from an attached stem 59. This stem is coupled to a top portion of the seating member 56 and has a length greater than the distance from the valve seat 55 to the top opening 61 of the valve case. Likewise, this stem 59 is shorter in length than the distance from the top opening 61 to the bottom opening 52.

A top plate 63 is attached at a top end of the stem 59 and provides support to suspend the seating member 56 within the flow channel 54. Typically, this plate 63 will have sufficient surface area to cover the top opening 61 to prevent debris from entering the valve mechanism. This suspended position corresponds to the rest position shown in FIG. 2, where the sphere 32 is sitting on the annular disk 40.

Operation of this embodiment is much like the earlier embodiment shown in FIG. 2. Gravity pulls the seating disk 56, stem 59 and plate 63 to the lower or rest position. In this position, the top opening 61 is blocked, except for weep holes 65 which allow pressure equalization to take place as gas is removed from the tank. A beveled edge 66 for the periphery of the plate matches a conforming bevel on the casement 67 so that the plate is guided into a proper rest position, with the top opening blocked. During refill operations by the operator of a tanker, exhaust fumes are sent through the flow channel 54 and encounter the seating member 56. This rapid flow of gasses forces the disk upward into the seated position shown as Item 58. This seated position blocks further flow of gasses from the vent to bank flow channel.

To assist in proper alignment of the seating disk 56 against the first valve seat 55, a pair of projecting crossarms 68 and 69 are provided which include a small opening 70 and 71 through which the stem 59 and lower stem 72 are journaled. It is important to note that these respective support arms 68 and 69 do not have a circular configuration which blocks flow through the flow channel 54. To the contrary, they are merely a form of narrow arm extending along the diameter of the flow channel. For example, the width of these respective arms need be no wider than approximately three times the width of the stem 59 and 72. These support arms function merely to maintain the stem in a coaxial orientation during its displacement from its rest position to the seated position 58. In this sense, the support arms operate as a track guide for displacement of the plate 65 upward from the top opening along the central axis of the flow channel.

The valve seat 55 is illustrated as a flat shoulder which is directly contacted by the flat surface of the disk which abutts against the valve seat. In this seated position, the top plate 63 is raised to the position shown by phantom lines in FIG. 5. Although the valve seat shown in FIG. 5 corresponds roughly to a flat surface, it will be apparent that such a valve seat could be formed by many different structures, including any surface forming a shoulder which abruptly decreases in radial opening of a smaller, first opening 75 to a larger, second opening 76. Likewise, the referenced support arms 68 and 69 are merely one form of means for maintaining the seating disk 56 in a relatively parallel planar relationship with respect to the seating shoulder 55 to ensure positive seal in response to rapid exhaust of gas fumes from the tank.

Based on the foregoing description of two embodiments, it will be apparent to those skilled in the art that other variations, including combinations of the two embodiments disclosed, are forseeable. Accordingly, it is to be understood that the scope of the subject invention is to be determined from the following claims, and is not to be dependent upon the specific embodiments set forth herein as the first and second preferred embodiments.

I claim:

1. A control valve for blocking atmospheric venting of gas fumes contained within a gasoline storage tank during tanker refill operations wherein the gasoline tank includes a venting tube coupled to open space within the top of the tank to provide air intake for pressure equalization as gasoline is gradually removed from the tank, said control valve comprising:

a. a rigid, tubular valve casing having a top opening, a bottom opening and a flow channel therebetween;

b. means for attaching the bottom end of the casing to an upper end of the venting tube such that the valve flow channel forms a continuation venting path for the venting tube;

c. first and second valve seats and an intermediate seating member coupled to the casing and at least partially contained within the flow channel, said seating member being configured in shape and size to form restricted air space between the seating member and a surrounding wall of the flow channel to be reversibly displaceable in response to fume exhaust expelled during refill operations, being displaceable along the flow channel between (i) a rest position wherein the seating member nests under force of gravity on the second valve seat and (ii) a sealed position wherein the seating member is raised by fluid flow against the gravity force to a sealed position at the first valve seat;

d. said second valve seat including weap holes therethrough positioned along the flow channel such that communication between an exterior environment and an unblocked segment of the flow channel is maintained when the seating member is in the rest position to enable gradual venting of the strage tank; and e. said first valve seat being configured to develop a full seal and blockage with the seating member in the sealed position wherein fluid flow through the weap holes of the second valve seat is blocked to thereby prevent forced evacuation of gas fumes during filling operations;

f. said first and second valve seats, seating member and flow channel be configured with minimal open space along and within the flow channel to enable rapidly moving gas fumes to build a sufficient pressure head to raise the seating member in sealing contact against the first valve seat.

2. A control valve as defined in claim 1, wherein the seating member comprises a sphere having a radius sufficiently small to allow the sphere to move freely within a portion of the flow channel between the resting and sealing positions and wherein the casing comprises a cylinder having a tubular bore along its central axis operable as the flow channel, the tubular bore having at least two different radial distances representing two separate bore sections, a first section toward the bottom opening of the flow channel having a radius which is substantially larger than the radius of the sphere and a second section positioned toward the top opening of the flow channel having a radius substantially smaller than the radius of the sphere, the first valve seat being formed as a tapered section of gradually decreasing radius from the first section of larger radius to the second section of smaller radius and in a configuration which provides sealing contact when the sphere is in a seated position at the tapered section.

3. A control valve as defined in claim 2, wherein the means for attaching the casing to the top end of the venting tube comprises a third radial bore positioned at the bottom opening of the casing and having a bore radius slightly larger than the outer radius of the venting tube, said third bore extending axially into the casing a sufficient distance to provide a stable support for the valve when inserted over the venting tube.

4. A control valve as defined in claim 2 wherein the second valve seat for providing the rest position for the spherical seating member comprises an annular disk having a central, circular opening with a radius substantially smaller than the radius of the sphere, said annular disk being positioned within the cylindrical bore at a base portion of the first bore section, thereby allowing the sphere to rest in the central opening when the storage tank is not being filled to prevent unimpeded venting of gas fumes to the atmosphere.

5. A control valve as defined in claim 4 wherein the weap holes are positioned within the annular disk in a location which is not obstructed by the sphere in its rest position.

6. A control valve as defined in claim 1, further comprising:

a stem attached axially at one end to a top portion of the seating member and having a length greater than the distance from the first valve seat to the top opening of the case, but shorter than the distance from the top opening to the bottom opening;

said second valve seat comprising top plate attached at a top end of the stem, said plate having sufficient surface area to cover the top opening of the casing, thereby suspending the seating member within the casing below the first valve seat when the plate is resting on the top opening.

7. A control valve as defined in claim 6, further comprising guide means coupled to the stem within the case for substantially restricting movement of the stem along a central axis of the flow channel, thereby providing a track guide for displacement of the plate upward from the top opening wherein the flow of fumes is merely impeded when the seating member is at the rest position, to a seated position of the seating member wherein exhaust of fumes is totally blocked.

8. A control valve as defined in claim 6 wherein the weap holes are positioned in the plate at the top opening of the case, thereby providing venting action to the tank when the seating member is in the rest position, while being blocked when the sphere is in the seated position.

9. A control valve as defined in claim 1, wherein the seating member comprises a disk having a radius sufficiently small to allow the disk to move freely within a portion of the flow channel between the resting and sealing positions and wherein the casing comprises a cylinder having a tubular bore along its central axis operable as the flow channel, the tubular bore having at least two different radial distances representing two separate bore sections, a first section toward the bottom opening of the flow channel having a radius which is substantailly larger than the radius of the disk and a second section positioned toward the top opening of the flow channel having a radius substantially smaller than the radius of the disk, the first valve seat being formed as a shoulder of abruptly decreasing radius from the first section of larger radius to the second section of smaller radius and in a configuration which provides sealing contact when the disk is in a seated position at the shoulder, and further comprising means for maintaining the disk in a relatively parallel planar relationship with respect to the seating shoulder to ensure a positive seal in response to rapid exhaust of gas fumes from the tank.

10. A control valve as defined in claim 9, further comprising:

a stem attached axially to a top side of the disk and having a length greater than the distance from the first valve seat to the top opening of the case, but shorter than the distance from the top opening to the bottom opening;

said second valve seat comprising a top plate attached at a top end of the stem, said plate having sufficient surface area to cover the top end of the casing and suspend the seating disk within the casing below the first valve seat when the plate is resting on the top opening; and guide means coupled to the stem within the case for substantially restricting movement of the stem along the central axis, thereby providing a track guide for displacement of the plate upward from the top opening wherein the flow of fumes is merely impeded when the disk is at a rest position, to a seated position of the disk wherein exhaust of the fumes is totally blocked.

11. A control valve as defined in claim 9 wherein the weap holes are positioned in the plate at the top opening of the case, thereby providing venting action to the tank when the disk is in the rest position, while being blocked when the disk is in the seated position.

* * * * *